US007131522B2

(12) United States Patent
Sircovich

(10) Patent No.: US 7,131,522 B2
(45) Date of Patent: Nov. 7, 2006

(54) STAIR LIFT SYSTEM

(76) Inventor: Oscar Sircovich, 29 Harakevet Street, 93502 Jerusalem (IL)

( * ) Notice: Subject to any disclaimer, the term of this patent is extended or adjusted under 35 U.S.C. 154(b) by 0 days.

(21) Appl. No.: 10/527,303

(22) PCT Filed: Aug. 31, 2003

(86) PCT No.: PCT/IL03/00714

§ 371 (c)(1),
(2), (4) Date: Mar. 8, 2005

(87) PCT Pub. No.: WO2004/022472

PCT Pub. Date: Mar. 18, 2004

(65) Prior Publication Data

US 2005/0241247 A1 Nov. 3, 2005

(30) Foreign Application Priority Data

Sep. 9, 2002 (IL) ..... 151654

(51) Int. Cl.
*B65G 15/00* (2006.01)

(52) U.S. Cl. ..... 198/322; 198/321

(58) Field of Classification Search ..... 198/321, 198/322, 326, 327, 328, 329, 330, 331, 332, 198/333
See application file for complete search history.

(56) References Cited

U.S. PATENT DOCUMENTS 2,341,463 A 2/1944 Maytham
5,234,078 A * 8/1993 Smith ..... 187/200
5,295,569 A * 3/1994 Kubota ..... 198/333
5,802,773 A * 9/1998 Pingel ..... 52/10
5,842,554 A * 12/1998 Stoxen et al. ..... 198/322
6,050,366 A * 4/2000 Lyons ..... 187/200
6,247,574 B1 * 6/2001 Yamaguchi et al. ..... 198/326
6,533,098 B1 * 3/2003 Winkler ..... 198/321
6,695,084 B1 * 2/2004 Wilk ..... 180/117
6,758,318 B1 * 7/2004 Weaver ..... 198/321

FOREIGN PATENT DOCUMENTS

FR 2 127 279 A 10/1972

* cited by examiner

*Primary Examiner*—Joe Dillon, Jr.
(74) *Attorney, Agent, or Firm*—Blakely Sokoloff Taylor & Zafman

(57) ABSTRACT

A stairs lift system capable of converting stairs climbing operation into a walking movement along a horizontal plane. The system comprises an existing substrate, flight of stairs, and a second, overlying layer of stairs. Each one of the overlying stairs comprises a lifting element. Mechanical, electronic or hydraulic means are provided for lifting the lifting element up to the height of next-in-line overlaying stair. The lifting means are activated when sensing the presence of a subject having stepped on the first-in-line lifting element. The first-in-line lifting element returns to the initial position once the subject has stepped over to the next-in-line stair; and so forth.

9 Claims, 9 Drawing Sheets

STAIR LIFT SYSTEM

The present patent application is a non-provisional application of International Application No. PCT/IL2003/000714, filed Aug. 31, 2003.

FIELD OF THE INVENTION

The present invention relates to elevating devices, more particularly to stairs lifting systems.

BACKGROUND OF THE INVENTION

Stair flights are the most common means for enabling individuals to climb to (or descend from) different levels in residential and other buildings. The most popular alternatives—though much more expensive and not always practicable—are elevators or escalators.

It is the object of the invention to offer an alternative solution, particularly for the elderly or less-fit persons, who live in residential buildings, multi level apartments or family houses, where retrofitting of an elevator is not possible for economic or other reasons.

It is a further object of the invention to provide an array of substitutional stairs readily installable on top of any existing stair flight, converting it into a so to speak "one level walking" elevator.

The closest prior art known to the Applicant are systems specially tailored for the handicapped, i.e. those who need wheelchairs—cf. U.S. Pat. No. 5,802,773.

SUMMARY OF THE INVENTION

Thus provided according to the present invention is a stairs lift system capable of converting the stairs climbing (or descending) operation into a walking movement along a horizontal plane, the system comprising: an existing substrate flight of stairs, a series of lifting elements, each supported on one of the substrate stairs, thus forming together a second, overlaying layer of stairs, each lifting element comprises: an open top container fitting the length, width and height of a substrate stair, a top panel forming a cover for the container, means for lifting the top panel up to the height of the next-in-line overlaying stair, means for activating the lifting means upon a control command, means for sensing the presence of a subject having stepped on the first-in-line lifting element top panel, means for issuing the control command to the next-in-line lifting element after the subject stepped thereover, and means for lowering the top panel of the first-in-line lifting element to the initial position once the control command has been issued, and so forth with respect to the remaining stairs of the flight.

BRIEF DESCRIPTION OF THE DRAWINGS

These and additional constructional features and advantages of the invention will become more clearly understood in the light of the ensuing description of a preferred embodiment thereof, given by way of example only with reference to the accompanying drawings, wherein.

DETAILED DESCRIPTION OF THE PREFERRED EMBODIMENTS

Figure 1:
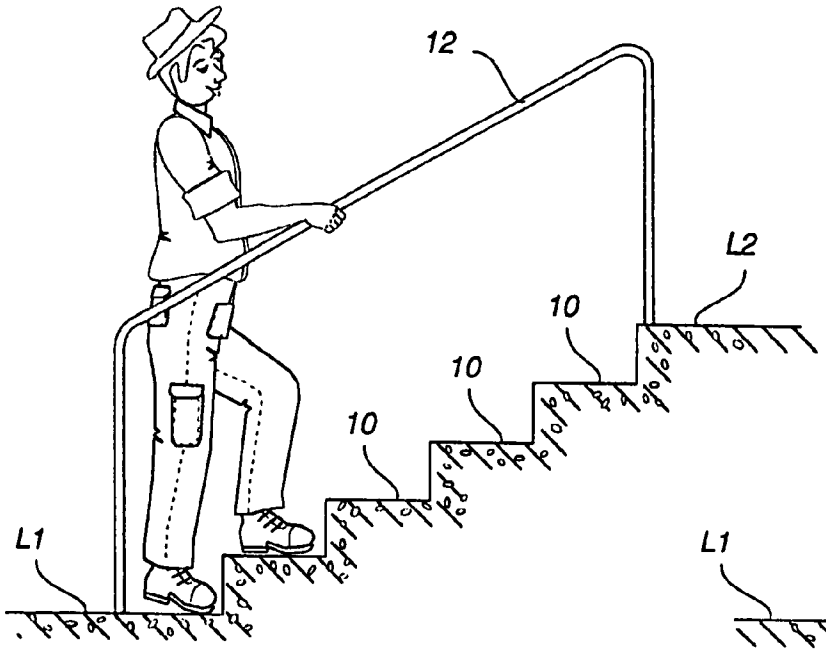
FIG. 1 is a schematic representation of a conventional flight of stairs.

A conventional flight of stairs is illustrated in FIG. 1. Hence, a plurality of stairs 10 are usually laid on a substrate (not shown) between lower level L1 and upper level L2. Typically the height of each stair is 14–21 cm. A handrail 12 is provided for convenience and safety.

Figure 2:
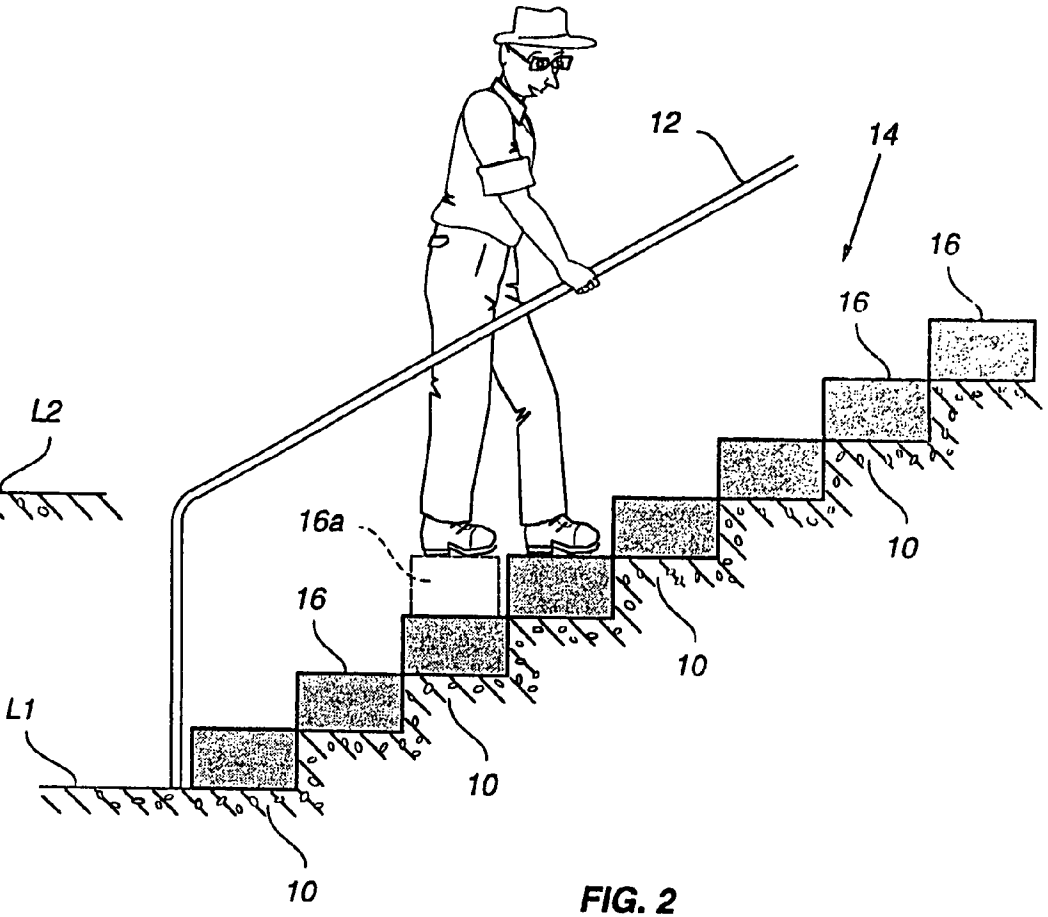
FIG. 2 illustrates the principles of the stairs lift system of the present invention.

The stairs lift system generally designated 14 in FIG. 2 comprises a plurality of lifting elements 16 in the form of crates or boxes following the measurements of and each laid on one of the substrate stairs 10, so that the same pattern of stairs is maintained.

Figure 3:
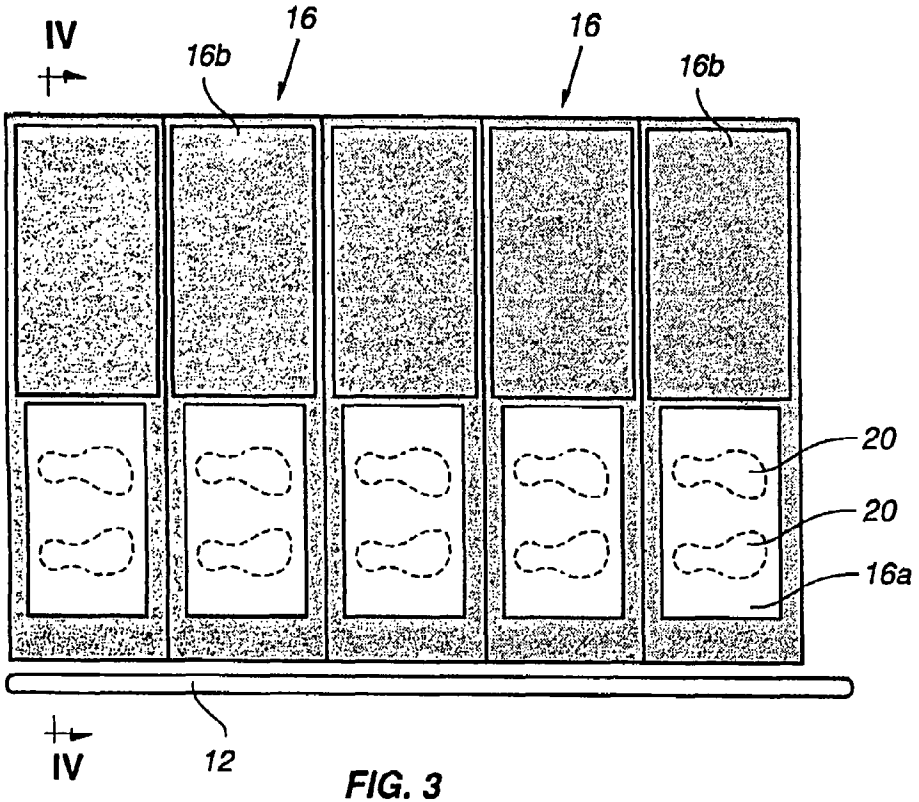
FIG. 3 is a top view of the stairs lift system of FIG. 2.

As further seen (FIG. 3), each element 16 comprises a tread portion 16*a* at the side near the handrail 12, which is adapted, at the proper timing (see below), to become lifted up to the level of the adjacent, higher stair. Hence, a climbing person can simply step over to the next-in-line stair by walking along a horizontal plane, with practically no effort.

In more detail, and as one out of many design options, the lifting element 16 is substantially hollow, and is comprised of an outer casing 18 configured to support at one side a fixed panel 16*b*.

Integrated with the liftable panel 16*a* are a pair of sensors denoted 20. In the present example, the sensors are foot pads operatively associated with microswitches 22, the arrangement being such that an electric circuit becomes closed (see also FIG. 14) only upon placing thereon both feet of the user. This arrangement is recommended as a measure of safety (see further explanation below).

Figure 5:
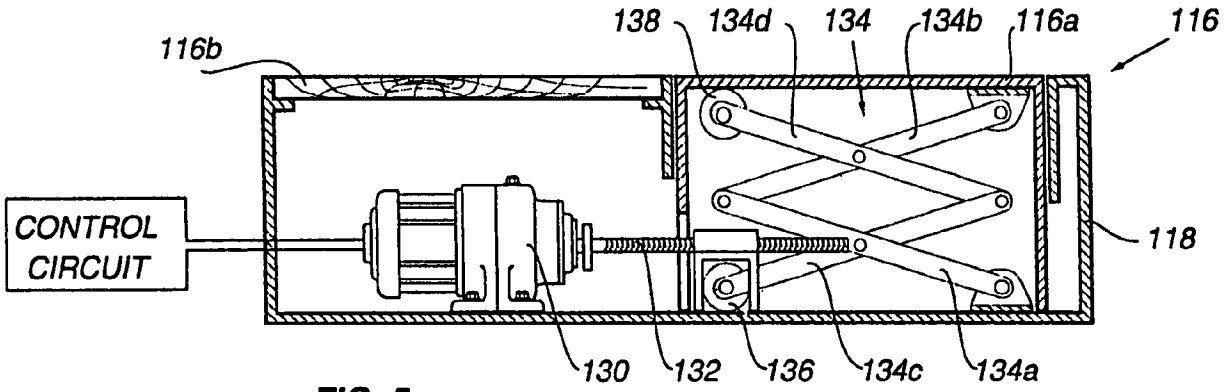
FIG. 5 is a schematic cross-sectional view of a lifting element according to a first mechanical version of the system in the withdrawn, inoperative position.

A first, mechanical embodiment of a lifting mechanism will be now described with reference to FIGS. 5 and 6. The left-hand compartment, below the fixed panel 116*b* conveniently serves a storage for an electric reversible (DC) motor 130. By screw-threaded spindle 132, the motor drives a lazy-tongs mechanism 134 comprising link 134*a* pivoted at one end to the base 118 and at its other end to link 134*b*. Link 134*b* is pivoted to the lifting panel 116*a*. Links 134*c* and 134*d* are pivoted to each other and to the links 134*a* and 134*b* as shown, and carry rollers 136 and 138, respectively, the former being installed in a cage 140 which is linearly driven by the spindle 132 by the screw-thread engagement.

Figure 6:
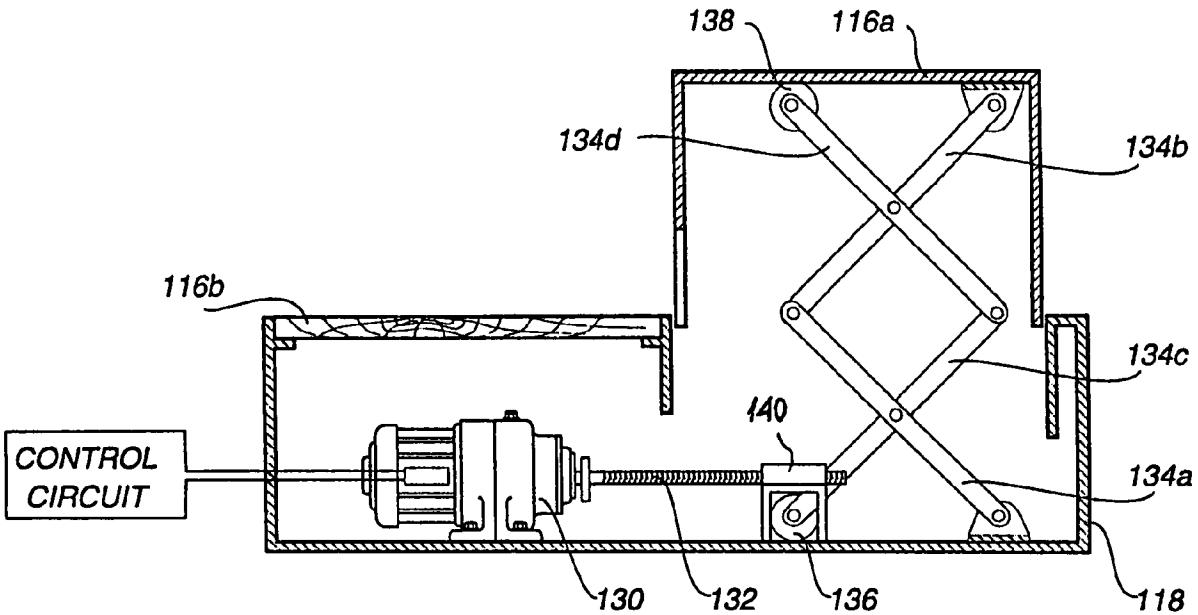
FIG. 6 is a sectional view of the element of FIG. 5 in the extended, operational position.

The lifting (and lowering) of the panel 116*a* is clearly depicted in FIG. 6, depending on the running direction of the motor 130.

Figure 7:
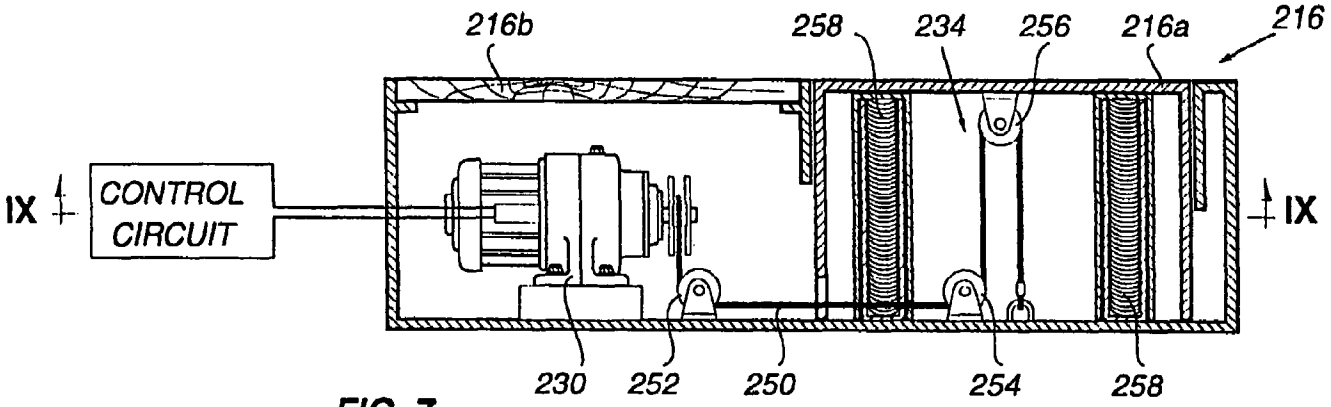
FIG. 7 is a schematic cross-sectional view of a lifting element according to a second mechanical version of the system in the withdrawn position.
Figure 8:
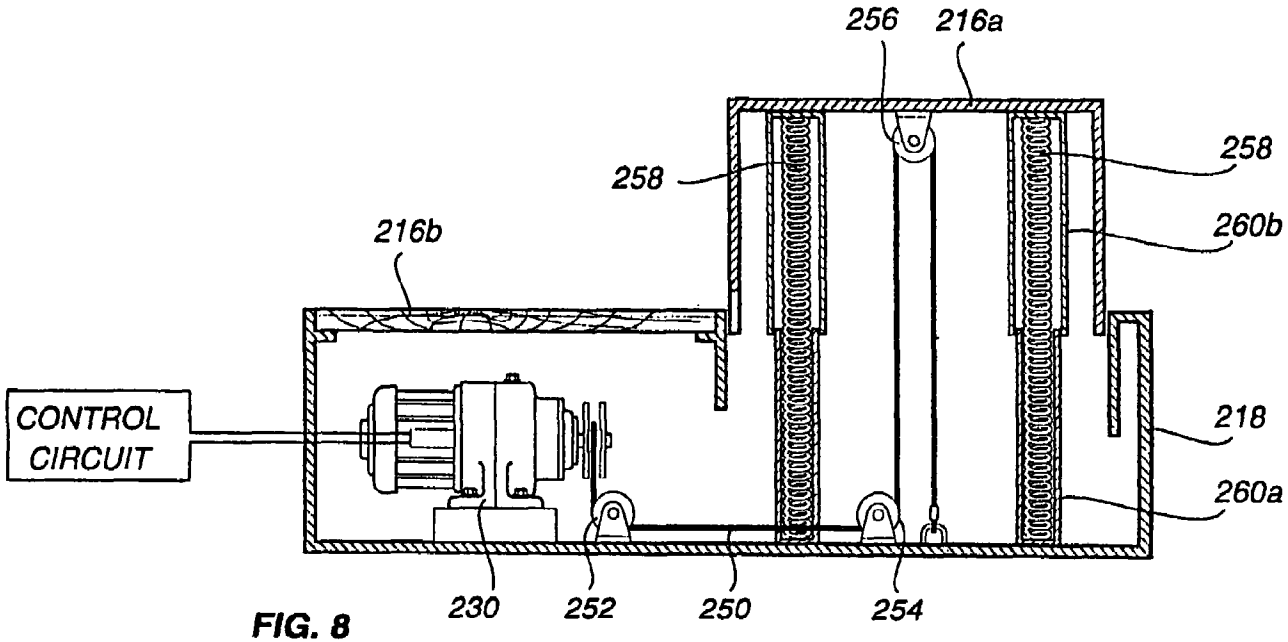
FIG. 8 is a section view of the element of FIG. 7 in the extended position.
Figure 9:
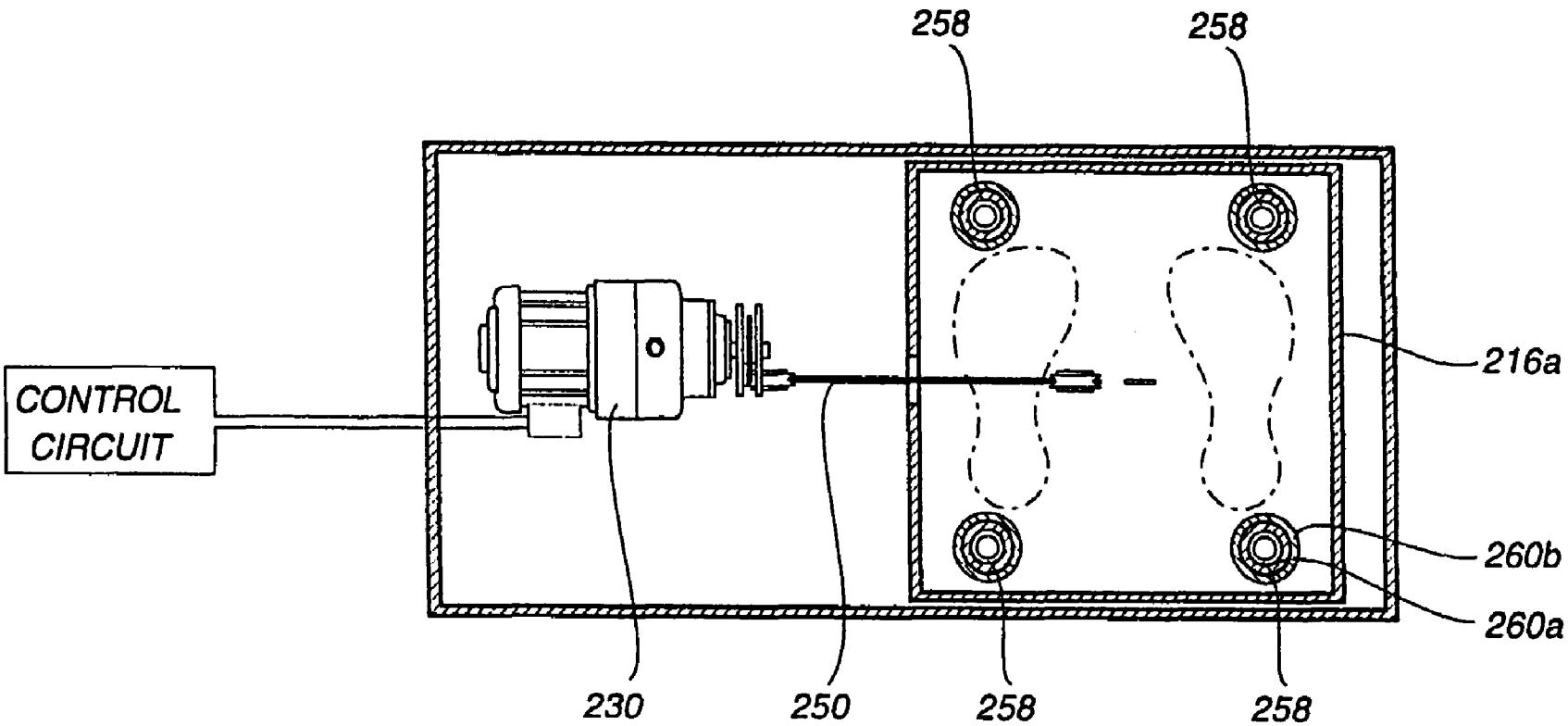
FIG. 9 is a sectional view taken along line IX—IX of FIG. 7.

Turning now to FIGS. 7–9, motor 230 is coupled to the lifting panel 216*a* intermediate a pulley block generally denoted 234. It comprises cable 250 slung over pulleys 252, 254, 256 and anchored against the bottom of the box 218.

The lift panel 216*a* is constantly urged upwards by four strong coil springs 258, by a force exceeding the maximum allowable weight (say, 100 kg.). The springs are suitably supported by telescopic tubes 260*a* and 260*b*.

Provoked by a "lifting" command of the control circuit, the motor will "let go" of the panel 216*a* which will start to rise under the force of the springs 258. Winding up the cable 250 will pull the panel 216*a* back to the initial state.

Figure 10:
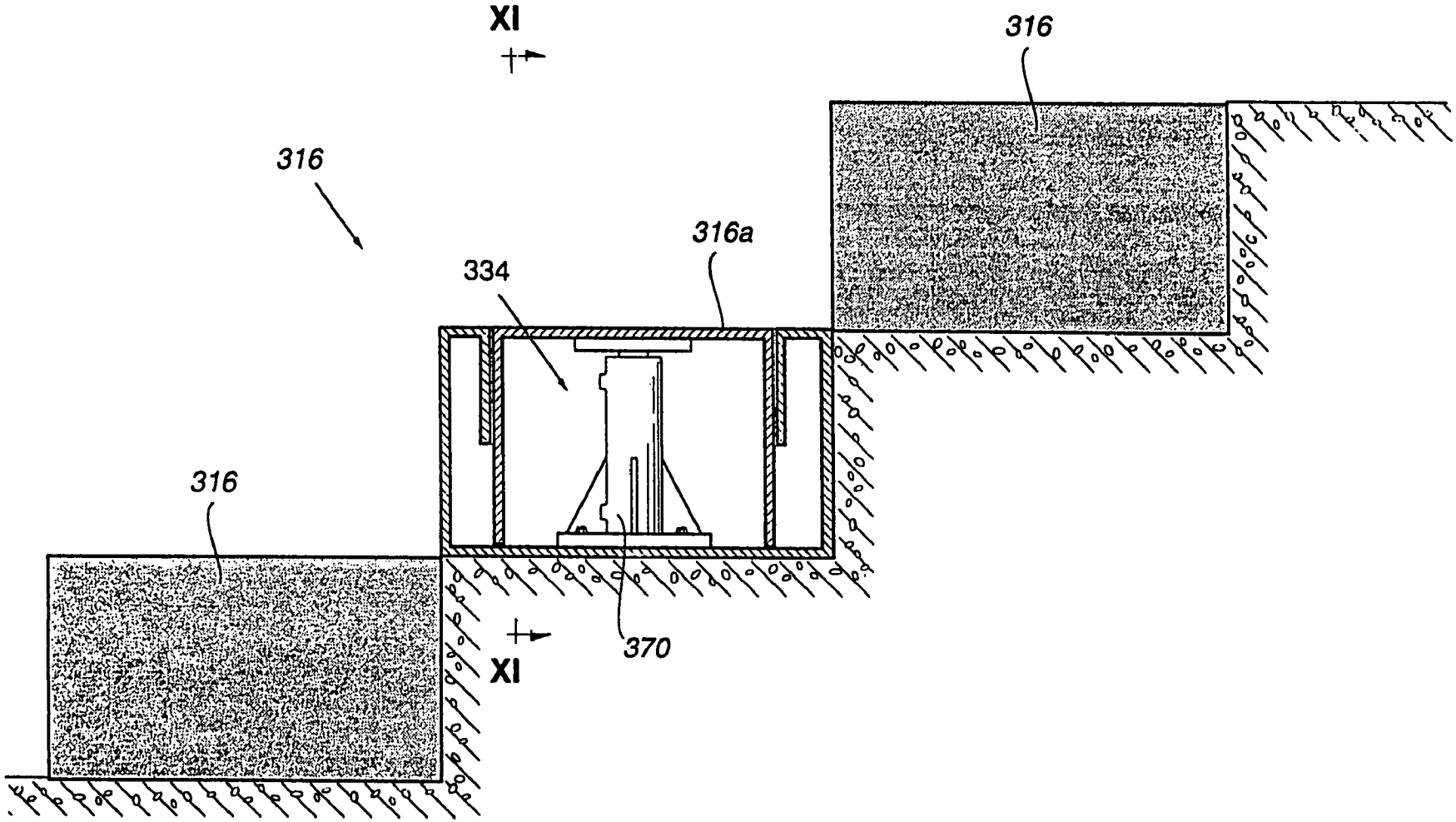
FIG. 10 is a schematic cross-sectional view of a lifting element according to a hydraulic version of the system in the withdrawn position.
Figure 11:
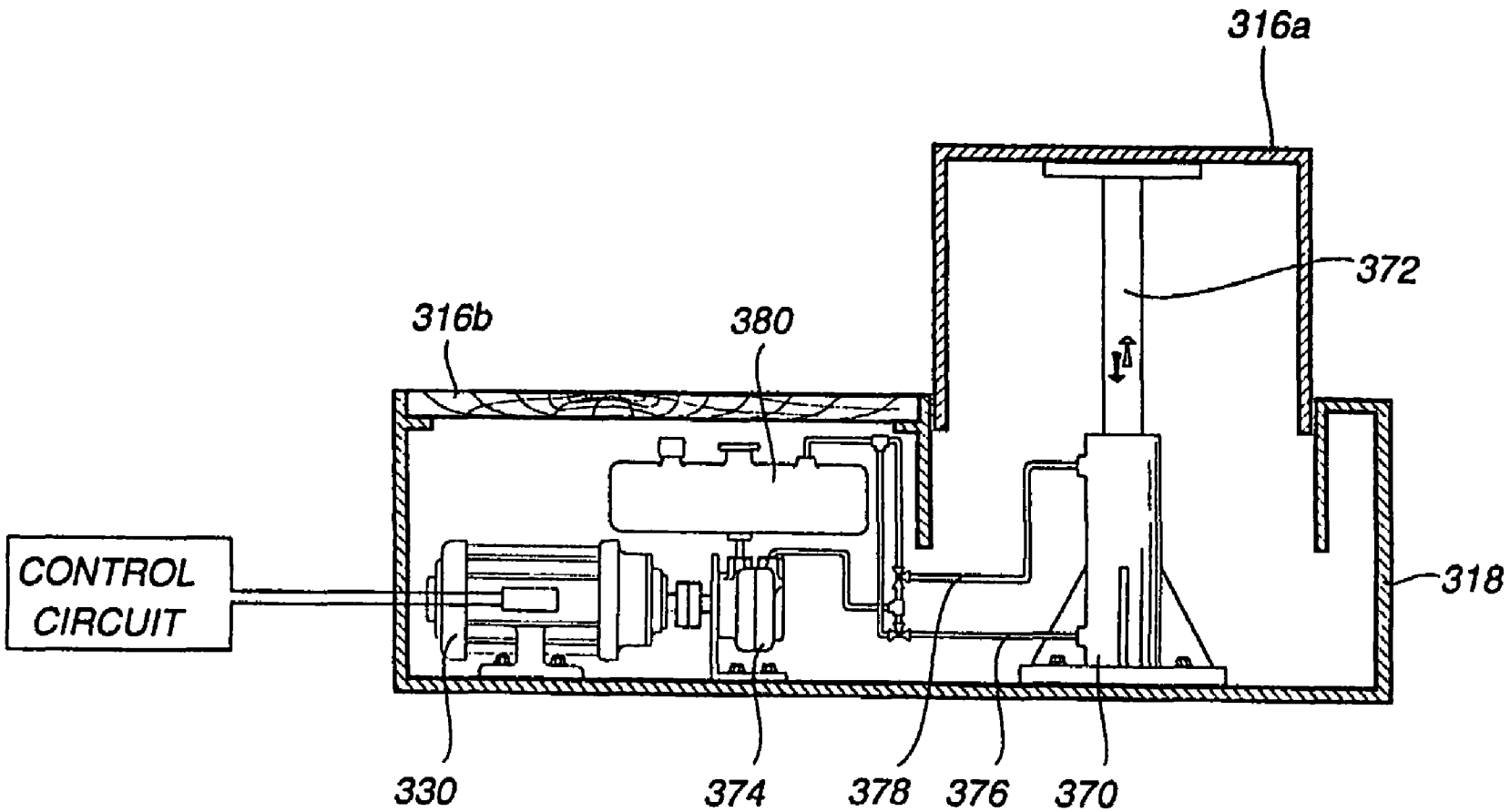
FIG. 11 is a sectional view of the element of FIG. 10 in the extended position.

A hydraulic version of the lifting mechanism 334 is illustrated in FIGS. 10 and 11. Hence, a hydraulic jack is used comprising cylinder 370 and piston 372 on which the lift panel 316*a* is supported.

The motor 330 is coupled to an oil pump 374. The pump 374 is connected by tube 376 to the lower side of the cylinder 370, and by tube 378 to the top side thereof. Oil is supplied from reservoir 380. Suitable check valves are installed as necessary for the lifting and lowering of the piston 372 as known per-se in the art.

Figure 4:
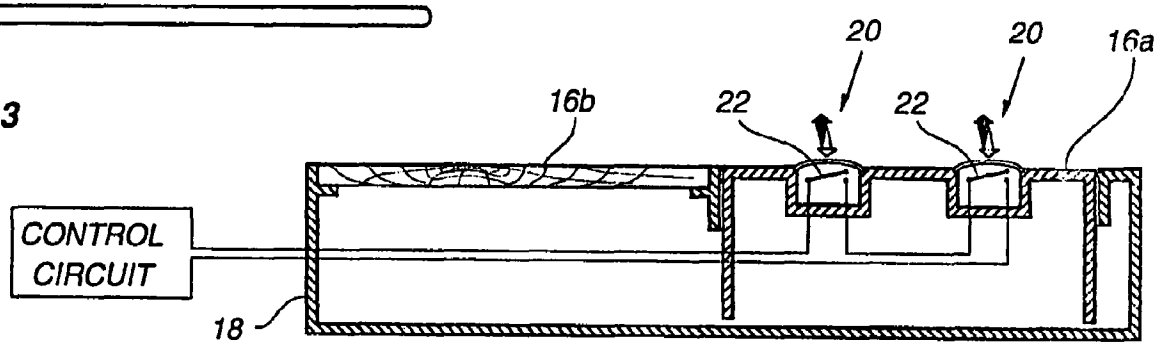
FIG. 4 is a cross-sectional view taken along line IV—IV of FIG. 3, illustrating the use of microswitch pad as means for sensing the presence of a subject having stepped over from one to the next lifting element.
Figure 12:
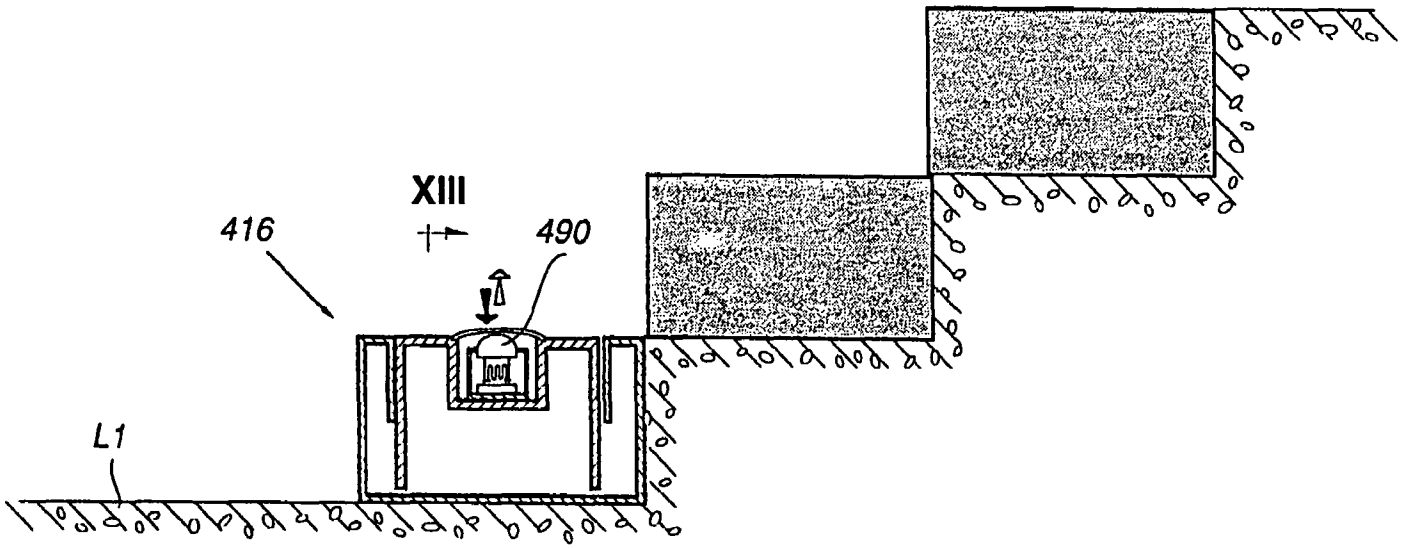
FIG. 12 is similar to FIG. 4 but employing pressure transducer for indicating the passage of the user from one step to the other.
Figure 13:
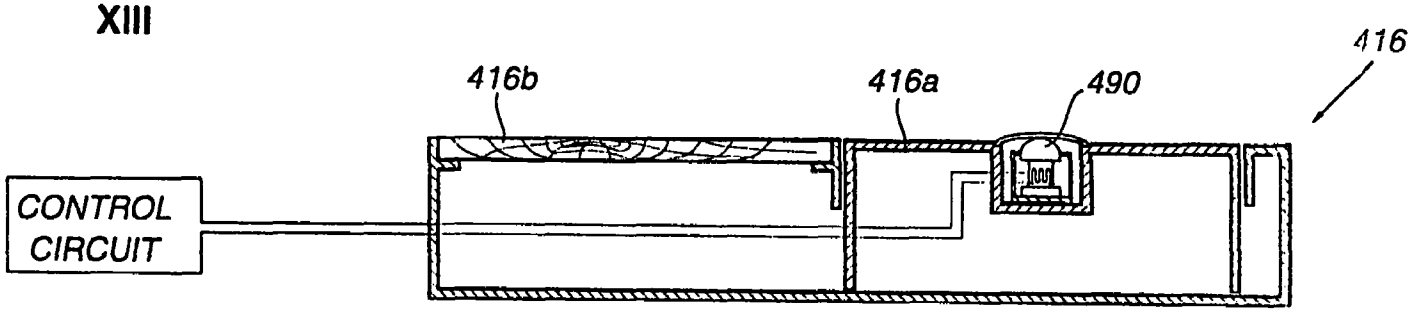
FIG. 13 is a sectional view taken along line XIII—XIII of FIG. 12.

FIGS. 12 and 13 exemplify alternative means for ascertaining that a person has stepped onto the tread panel and is ready to be lifted up to the next stair (instead of using microswitches as described in conjunction with FIG. 4).

As schematically shown, piazoelectric or other known type of press gauges 490 is installed so that in the standby, withdrawn position, a measurement proportional to the weight of a person, standing on the first stair (at level L1) is received and recorded for the following series of stair liftings.

The next lifting will be enabled only after the press-gauge of such next stair indicates that the full weight of the user has in fact been shifted, namely that he left the former lifting element and is ready for the next lifting operation and the withdrawal of the panel behind.

Figure 14:
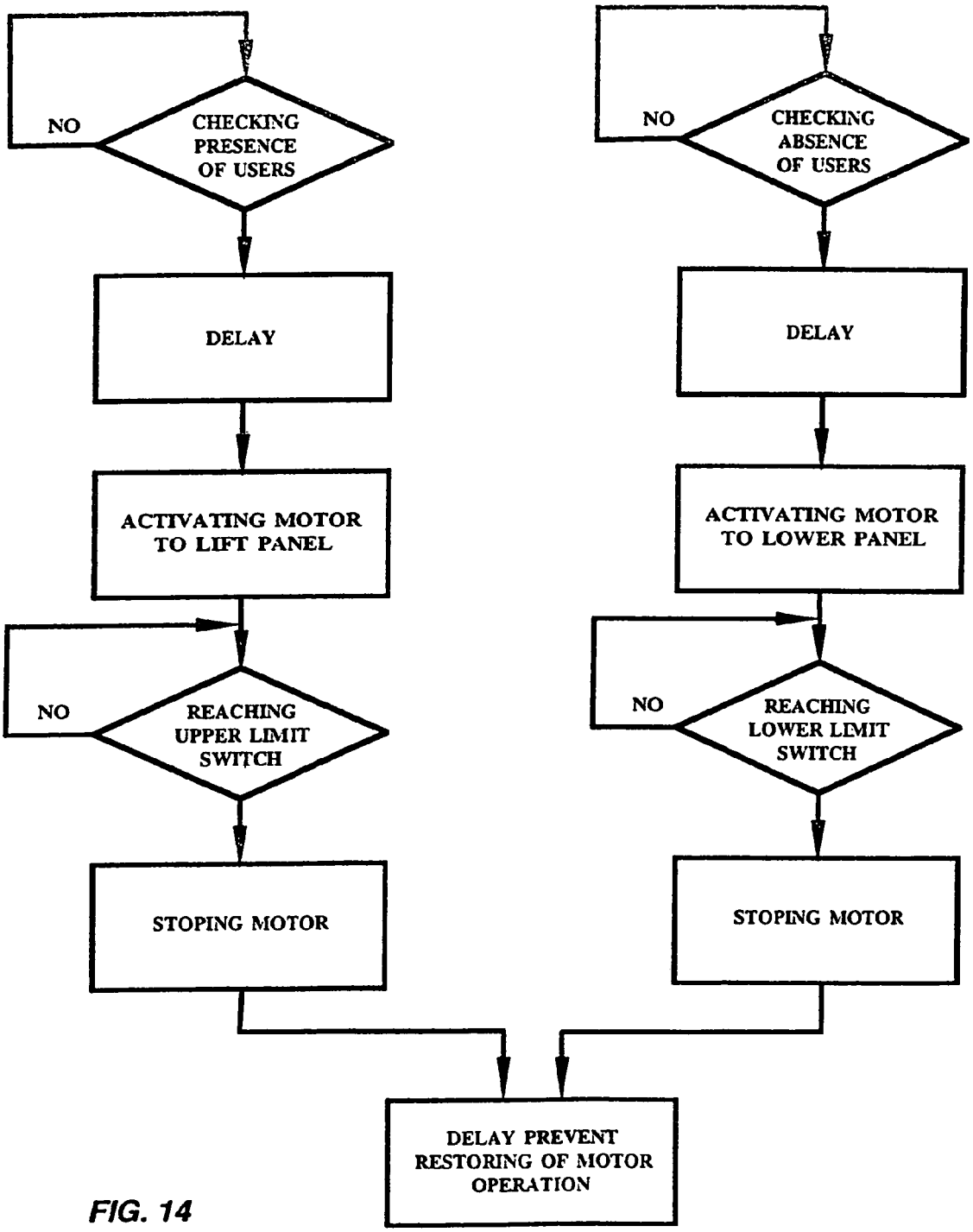
FIG. 14 is flow chart of the system.

The sequential operation of the stair lift system will be now described with reference to the flow chart of FIG. 14. The chart reflects one full cycle, namely, the lifting and then the lowering of any given tread panel by any one of the operating systems exemplified above.

The left-hand side of the diagram relates to the lifting string of operations. Hence, the control system is in standby position until positively sensing the presence of a subject (both microswitch 22 are closed, or full resting weight applied to press-gauge 490).

After a certain delay, for allowing the user to get ready for lifting, the respective motor is activated to commence the lifting stage.

Once the required level is reached (e.g. sensed by a suitable limit switch associated with the lifting panel or by other suitable means known per-se), the motor is stopped and its operation delayed, either for a given time period or, advantageously for extra safety, until some time after the lifting phase of the next element has started (or even completed!). This would ensure that the user no longer depends in any way on the previously lifted panel, and is fully supported by the next element.

The sequence of stages as above described is now repeated but in the descending direction (see right hand side of the chart).

It has thus been established that the proposed invention offers a neat, relatively low cost solution to the problem at hand as described in the preamble hereto.

Those skilled in the art to which this invention pertains will readily appreciate that numerous changes, variations and modifications can be effectuated without departing from the true spirit and scope of the invention as defined in and by the appended claims.

Thus, for example, the system is readily convertible to be used for descending a flight of stairs, should the need for such use arise.

Another obvious option is to operate the system in a continuous escalator-like fashion.

The system is readily adapted to be applied to non linear flights of stairs such as in curves or of the spiral type.

What is claimed is:

1. A stairs lift system capable of converting a stair climbing, or descending, movement into a walking movement along a horizontal plane, the system comprising:

An existing substrate flight of stairs; and a series of lifting elements, each supported on one of the substrate stairs, thus forming together a second, overlying layer of stairs, each lifting element comprises:

an open top container fitting the length, width and height of a substrate stair;

a top panel forming a cover for the container;

means for lifting the top panel up to the height of the next-in-line overlying stair;

means for activating the lifting means upon a control command;

means for sensing the presence of a subject having stepped on the first-in-line lifting element top panel;

means for issuing the control command to the next-in-line lifting element after the subject stepped thereover; and means for lowering the top panel of the first-in-line lifting element to the initial position once the control command has been issued;

wherein each lifting element operates sequentially to change the subjects movement.

2. The system as claimed in claim 1 wherein the top panel is supported on a mechanical lifting system.

3. The system as claimed in claim 2 wherein the mechanical lifting system comprises an electric motor driving a lazy-tongs system.

4. The system as claimed in claim 2 wherein the mechanical lifting system comprises an electric motor driving a pulley block.

5. The system as claimed in claim 1 wherein the top panel is supported on a hydraulic cylinder and piston assembly operatively coupled to an electrically operated hydraulic pump.

6. The system as claimed in claim 1 wherein the subject presence sensing means comprise at least one microswitch-operating pad.

7. The system as claimed in claim 6 wherein a pair of said pads are installed, one for each foot of the user.

8. The system as claimed in claim 1 wherein the subject presence sensing means comprises a press-gauge device adapted to be activated by the weight of the subject.

9. The system as claimed in claim 8 further comprising means for disabling the issuance of the control command subject to the transition of said weight to the next-in-line lifting element.

* * * * *